US006379232B1

(12) United States Patent
D'Aquila

(10) Patent No.: US 6,379,232 B1
(45) Date of Patent: Apr. 30, 2002

(54) BELT LIFT ACCESSORY FOR COMBINATION BELT AND DISK SANDER AND METHOD FOR MAKING SAME

(76) Inventor: Salvatore Louis D'Aquila, 1457 Rex St., Point Roberts, WA (US) 98281

( * ) Notice: Subject to any disclaimer, the term of this patent is extended or adjusted under 35 U.S.C. 154(b) by 0 days.

(21) Appl. No.: 09/811,290

(22) Filed: Mar. 16, 2001

(51) Int. Cl.[7] ..... B24B 21/00
(52) U.S. Cl. ..... 451/303; 451/296
(58) Field of Search ..... 451/296, 300, 451/302, 303, 442, 451, 480, 28

(56) References Cited

U.S. PATENT DOCUMENTS 994,358 A * 6/1911 Wysong ..... 451/303
1,493,779 A * 5/1924 Humphreys ..... 451/303
2,296,990 A * 9/1942 Fowler ..... 451/303
4,084,356 A * 4/1978 Brears ..... 451/303
4,204,371 A * 5/1980 Horwitz ..... 451/303

* cited by examiner

*Primary Examiner*—Derris H. Banks
(74) *Attorney, Agent, or Firm*—Sidley Austin Brown & Wood, LLP

(57) ABSTRACT

My invention is a device to facilitate sanding concave and convex shapes more evenly on a belt sander. My invention raises the center of the sanding belt and provides a section of belt that has no backing support. The unbacked area of belt forms a variable concave sanding surface when the workpiece is held against it with varying degrees of pressure. The arched top of my invention provides a wide radius sanding surface for concave workpieces. The curvature of the arched top of my invention reduces the area of contact with the inner surface of the belt when in an unloaded or idling state and helps the belt and the belt lift accessory operate at lower temperatures. The dimensions of my invention may vary depending upon the particular host machine it is designed to fit. My invention is simple to mount and remove without the use of tools. My invention can be used in a variety of shop applications on wood, metal and plastics.

4 Claims, 6 Drawing Sheets

Belt Rotation CCW

BELT LIFT ACCESSORY FOR COMBINATION BELT AND DISK SANDER AND METHOD FOR MAKING SAME

BACKGROUND

The belt lift was developed to facilitate sanding curved surfaces on a combination belt and disk sander. The flat belt surface of the combination belt and disk sander provides no concave sanding surfaces. The work easily develops facets or flat spots from the flat sanding surface. By raising the belt with a support fixed to the sander bed and running the belt over it, two sections of belt which are supported only by tension, with no rigid backing are created. By forcing the work down on the unbacked area of the belt, a concave sanding surface is achieved. The tensioning springs of the sander allow this movement of the belt by compressing when pressure is applied to the work. The facet problem is greatly reduced on work with convex curves. The contoured top surface is effective in sanding concave curves with a much longer radius than the rollers of the belt sander.

PRIOR ART

| U.S. Patent Documents | | |
|---|---|---|
| D293,763 | Arehart | Jan. 19, 1988 |
| 5,199,220 | Steiner et al. | April 6, 1993 |
| 5,168,656 | Jolly et al. | Dec. 8, 1992 |

DRAWINGS

1/6 FIG. 1 is a perspective view of my invention

Figure 4:
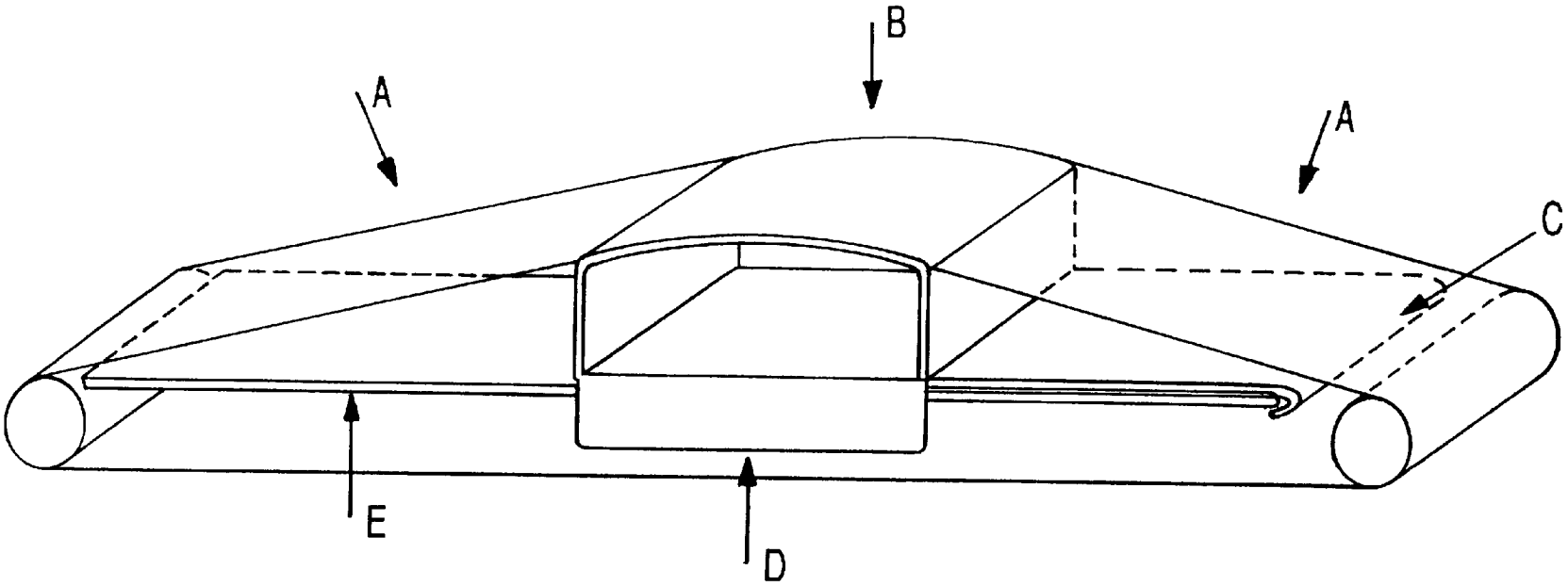

2/6 FIG. 4 is a perspective view of my invention showing mounting and feature details thereof

Figure 5:
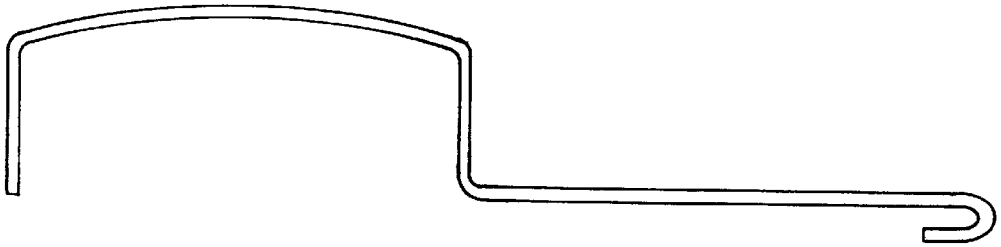
Figure 6:
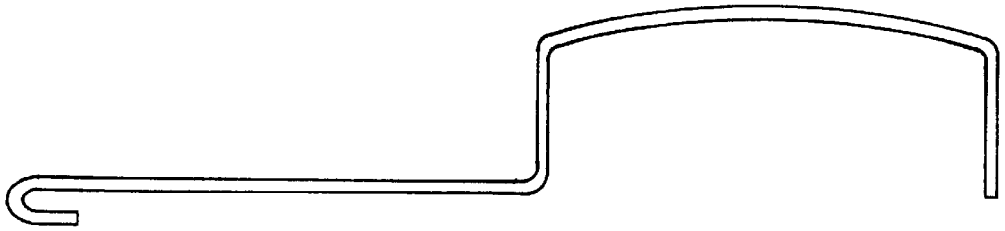

3/6 FIG. 5 is a right elevation of alternate construction number 1 thereof FIG. 6 is a left elevation of alternate construction number 1 thereof

Figure 7:
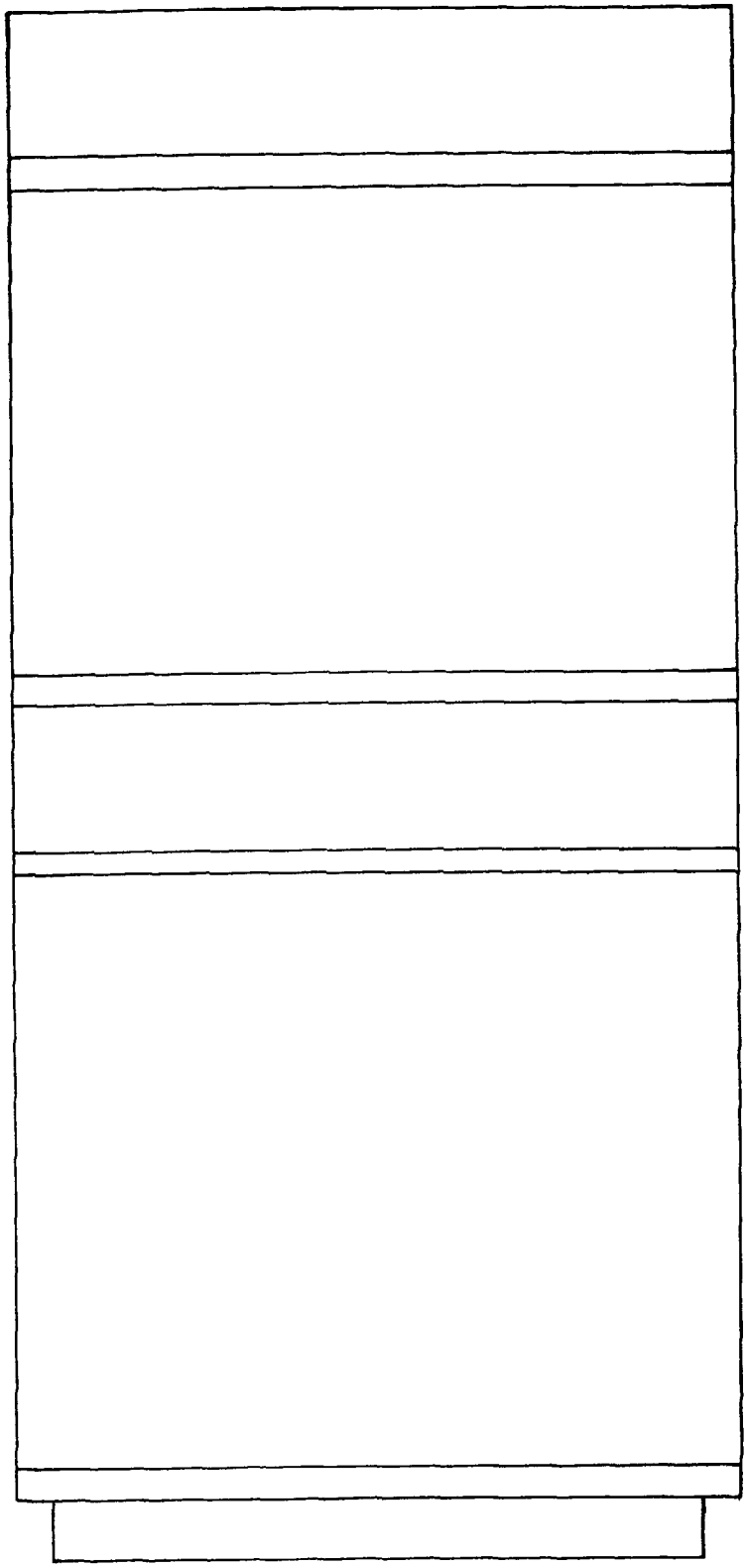

4/6 FIG. 7 is a layout view of alternate construction number 1 thereof

Figure 8:
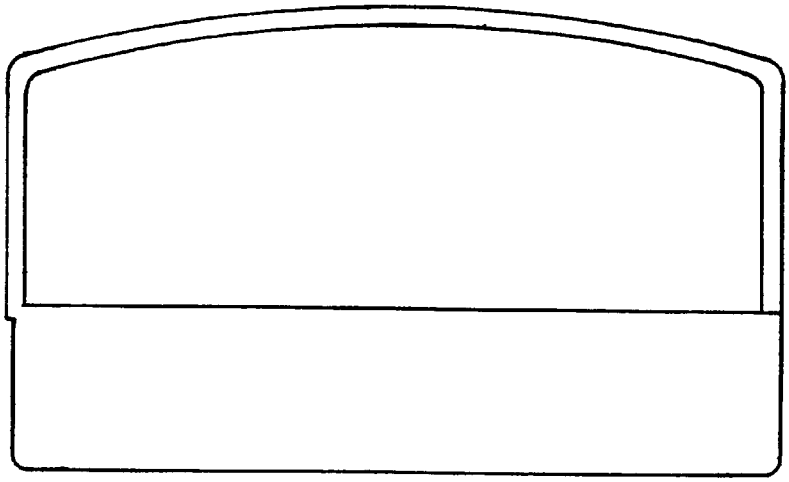
Figure 9:
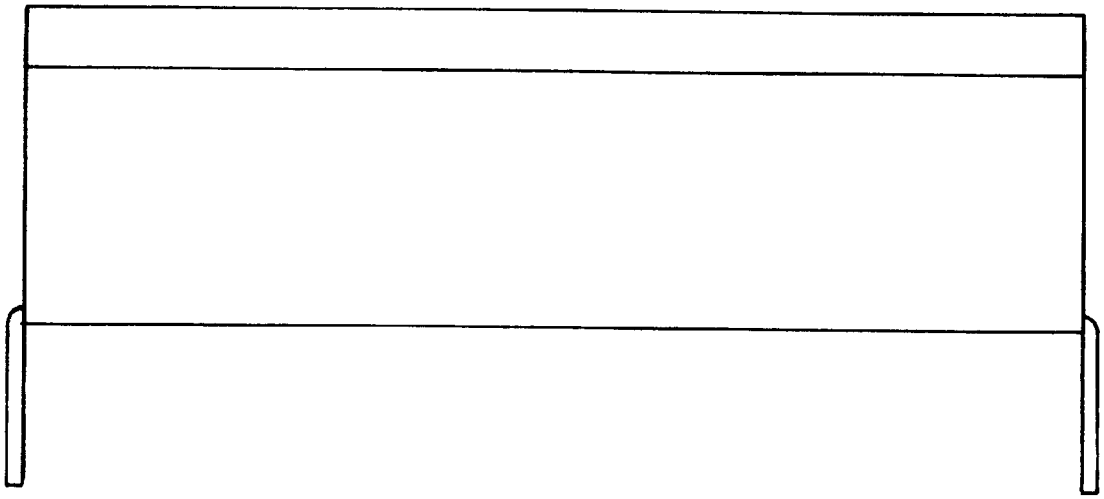

5/6 FIG. 8 is a left elevation of alternate construction number 2 thereof FIG. 9 is a front elevation of alternate construction number 2 thereof

Figure 10:
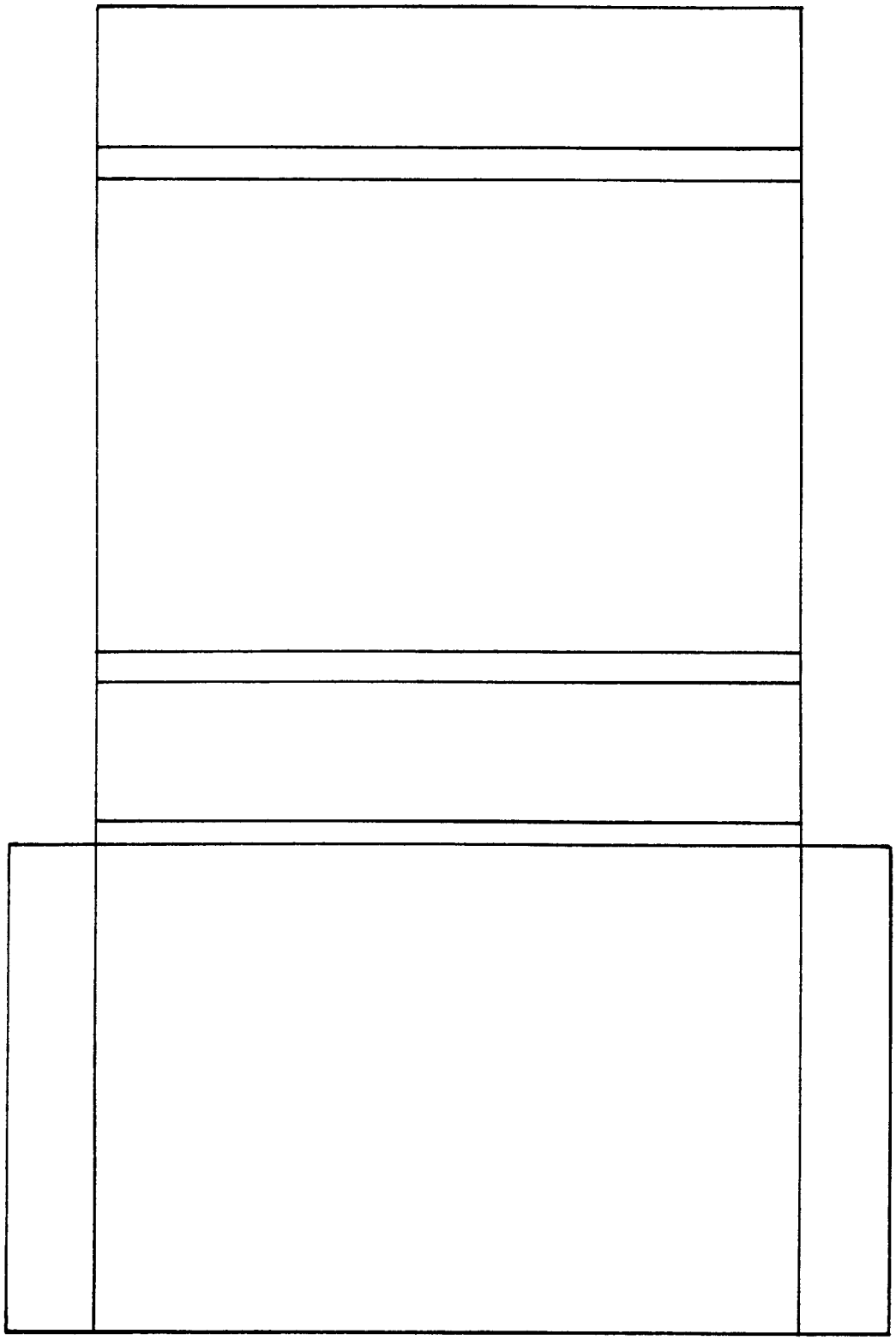

6/6 FIG. 10 is a layout view of alternate construction number 2 thereof

DESCRIPTION

The belt lift accessory for combination belt and disk sanders (U.S. Pat. Nos. 5,199,220, 5,168,656, and D293, 763) is a removable accessory that supports the sanding belt above the belt sander platen or frame (2/6, FIG. 4, Detail E) providing two sections of the belt that will flex under pressure (2/6, FIG. 4, Detail A). My invention also provides an upper curved section (2/6, FIG. 4, Detail B). The combination belt and disk sander is referred to as the host machine in this document.

My invention is constructed using a single piece of mild steel sheet with a minimum thickness of 1/16 inch. The steel is cut as per the layout drawings (4/6, FIG. 7) or (6/6, FIG., 10). It should be noted that all dimensions are based upon fitting a particular host machine (Delta model 31-460C) and will vary by application. In all cases the dimensions should be such that my invention is centered both from side to side and longitudinally between the belt sander rollers. The steel is rolled and folded using standard sheet metal working tools. The shaded areas of the layout drawings (4/6, FIG. 7 and 6/6 FIG. 10) represent radiused bends.

The top of the arched surface (2/6, FIG. 4, Detail B) of all construction alternatives is shaped to lower friction and aid cooling. The curvature shown in all drawings in this application are optimized for a belt sander using a 4"×36" belt.

Figure 1:
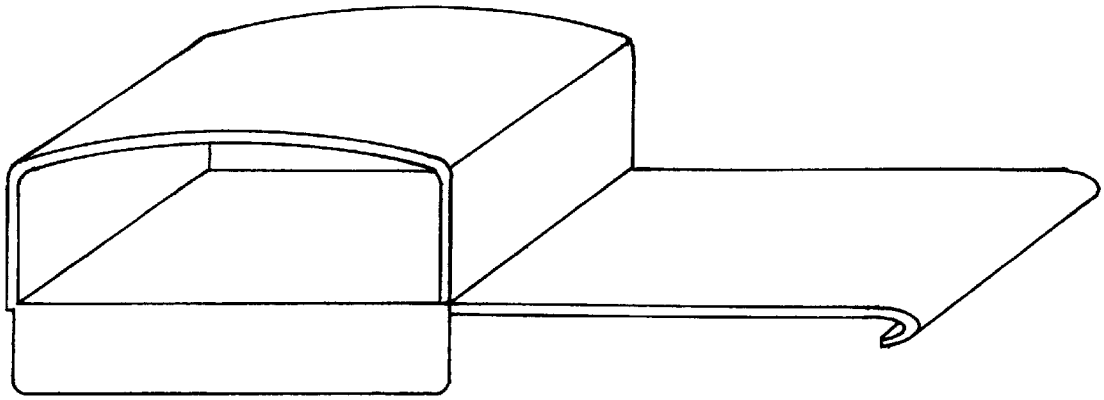
Figure 2:
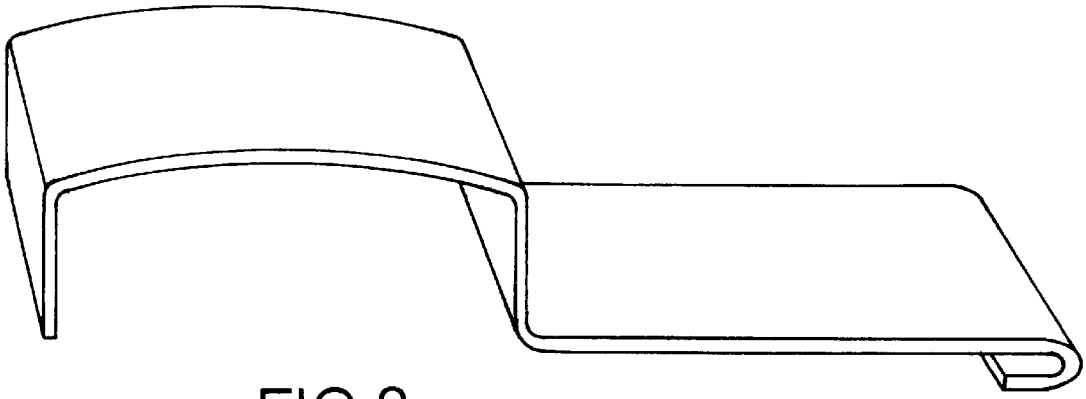
FIG. 2 is a perspective view of alternate construction number 1 thereof
Figure 3:
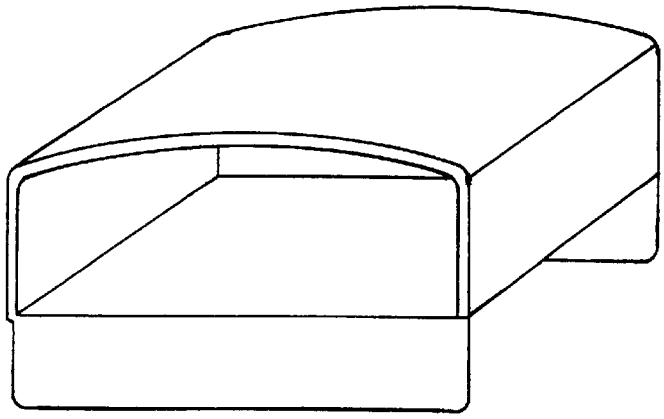
FIG. 3 is a perspective view of alternate construction number 2 thereof

Mounting is accomplished by releasing the tension of the belt on the host machine, removing the belt, and placing my invention into position centered on the belt sander frame. The host machine fence should either be adjusted to suit or removed depending upon the workpiece. The belt is then replaced, running over my invention, and tensioned. My invention is held in place by belt tension and is held square to the direction of belt travel by the lower brackets (2/6, FIG. 4, Detail D) of the invention as shown in (1/6, FIG. 1 and FIG. 3). My invention is held in place and centered between the host machine rollers by the folded edge (2/6, FIG. 4, Detail C) being hooked over the edge of the host machine frame (2/6, FIG. 4, Detail E) in the case of alternate construction 1, (1/6, FIG. 2). The tracking adjuster on the host machine can be adjusted to align the belt if necessary on all construction alternatives.

While I have described preferred embodiment of my invention, it will be understood that many other modifications may be made without deviating from the principles thereof; thereby I wish to be limited not by the foregoing description, but solely by the claims granted to me.

What is claimed is:

1. A belt lift accessory for a combination belt and disc sander including a platen for supporting a sanding belt, the belt lift accessory comprising a substantially rectangular frame having a substantially flat base for lying on the sanding belt supporting platen and having a width corresponding to a width of the sanding belt-supporting platen, an arcuate top vertically spaced from the base for curving and tensioning an upper run of the sanding belt, and two, spaced from each other, vertical side walls extending substantially transverse to a longitudinal extent of the rectangular frame for supporting the top in a spaced relationship to the base; and two brackets secured to opposite longitudinal edges of the base and extending downward therefrom for engaging side longitudinal surfaces of the platen for securing the rectangular frame thereon.

2. A belt lift accessory as set forth in claim 1, further comprising a plate forming an extension of the base and connected to a lower transverse edge of one of the two side walls, the plate having, at a free end thereof, a hook-shaped end portion for engaging a free end of the sanding belt-supporting platen.

3. A belt lift accessory as set forth in claim 1, wherein the frame, the, brackets, and the extension plate are formed as a one-piece element.

4. A belt lift accessory as set forth in claim 2, wherein the one-piece element is formed of sheet metal.

* * * * *